US011331915B2

(12) United States Patent
Chen et al.

(10) Patent No.: US 11,331,915 B2
(45) Date of Patent: May 17, 2022

(54) FLUID EJECTION DIES

(71) Applicant: HEWLETT-PACKARD DEVELOPMENT COMPANY, L.P., Spring, TX (US)

(72) Inventors: Chien-Hua Chen, Corvallis, OR (US); Michael W. Cumbie, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 248 days.

(21) Appl. No.: 16/465,220

(22) PCT Filed: Mar. 15, 2017

(86) PCT No.: PCT/US2017/022549
§ 371 (c)(1),
(2) Date: May 30, 2019

(87) PCT Pub. No.: WO2018/169526
PCT Pub. Date: Sep. 20, 2018

(65) Prior Publication Data

US 2021/0283910 A1 Sep. 16, 2021

(51) Int. Cl.
*B41J 2/14* (2006.01)

(52) U.S. Cl.
CPC ..... *B41J 2/1408* (2013.01)

(58) Field of Classification Search
CPC .. B41J 2/04591; B41J 2/04563; B41J 2/0458; B41J 2/04581; B41J 2/03; B41J 2/04531; B41J 2/04538; B41J 2/0454; B41J 2/04553; B41J 2/04565; B41J 2/17556; B41J 2/1408; B41J 2/055; B41J 29/377; B41J 2002/14354; B41J 2202/08
See application file for complete search history.

(56) References Cited

U.S. PATENT DOCUMENTS

| | | | |
|---|---|---|---|
| 5,631,676 | A | 5/1997 | Karz |
| 6,174,055 | B1 | 1/2001 | Sugikubo et al. |
| 8,033,642 | B2 | 10/2011 | Shihoh et al. |
| 8,382,231 | B2 | 2/2013 | Takano et al. |
| 9,162,453 | B2 | 5/2015 | Cruz-Uribe et al. |
| 2003/0052944 | A1 | 3/2003 | Scheffelin |
| 2005/0051518 | A1 | 3/2005 | Vitello |
| 2007/0188560 | A1 | 8/2007 | Zapka |
| 2009/0141062 | A1 | 6/2009 | Takano et al. |
| 2011/0205303 | A1 | 8/2011 | Pan |

(Continued)

FOREIGN PATENT DOCUMENTS

| | | |
|---|---|---|
| CA | 2344931 | 5/2000 |
| CN | 1324301 | 11/2001 |

(Continued)

OTHER PUBLICATIONS

Silicon Mems Printhead FAQ, Nov. 22, 2016, <http://imieurope.com/inkjet-blog/2016/11/22/silicon-mems-printhead-faq >.

*Primary Examiner* — Kristal Feggins
(74) *Attorney, Agent, or Firm* — Fabian VanCott

(57) ABSTRACT

A fluid ejection device may include a fluid ejection die embedded in a moldable material, a number of fluid actuators within the fluid ejection die to recirculate fluid within a number of firing chambers of the fluid ejection die, and a number of cooling channels defined in the moldable material thermally coupled to the fluid ejection die.

20 Claims, 11 Drawing Sheets

(56) References Cited

U.S. PATENT DOCUMENTS

| | | | |
|---|---|---|---|
| 2013/0293641 | A1 | 11/2013 | Essen |
| 2015/0239238 | A1 | 8/2015 | Yamada |
| 2016/0009082 | A1 | 1/2016 | Chen |
| 2017/0036451 | A1 | 2/2017 | Chen |

FOREIGN PATENT DOCUMENTS

| | | | |
|---|---|---|---|
| CN | 1925985 | | 3/2007 |
| CN | 101198473 | | 6/2008 |
| CN | 102202896 | | 9/2011 |
| CN | 104619501 | | 5/2015 |
| CN | 106232366 | A | 12/2016 |
| EP | 3134266 | | 3/2017 |
| JP | 2281958 | | 11/1990 |
| JP | 2005066995 | | 3/2005 |
| JP | 2007168112 | | 7/2007 |
| JP | 2007230085 | | 9/2007 |
| JP | 2012061704 | | 3/2012 |
| WO | WO-2011146149 | | 11/2011 |

FLUID EJECTION DIES

BACKGROUND

A fluid ejection die in a fluid cartridge or print bar may include a plurality of fluid ejection elements or a surface of a silicon substrate. By activating the fluid ejection elements, fluids may be printed on substrates. The fluid ejection die may include resistive elements used to cause fluid to be ejected from the fluid ejection die.

BRIEF DESCRIPTION OF THE DRAWINGS

The accompanying drawings illustrate various examples of the principles described herein and are a part of the specification. The illustrated examples are given merely for illustration, and do not limit the scope of the claims.

Figure 1A:
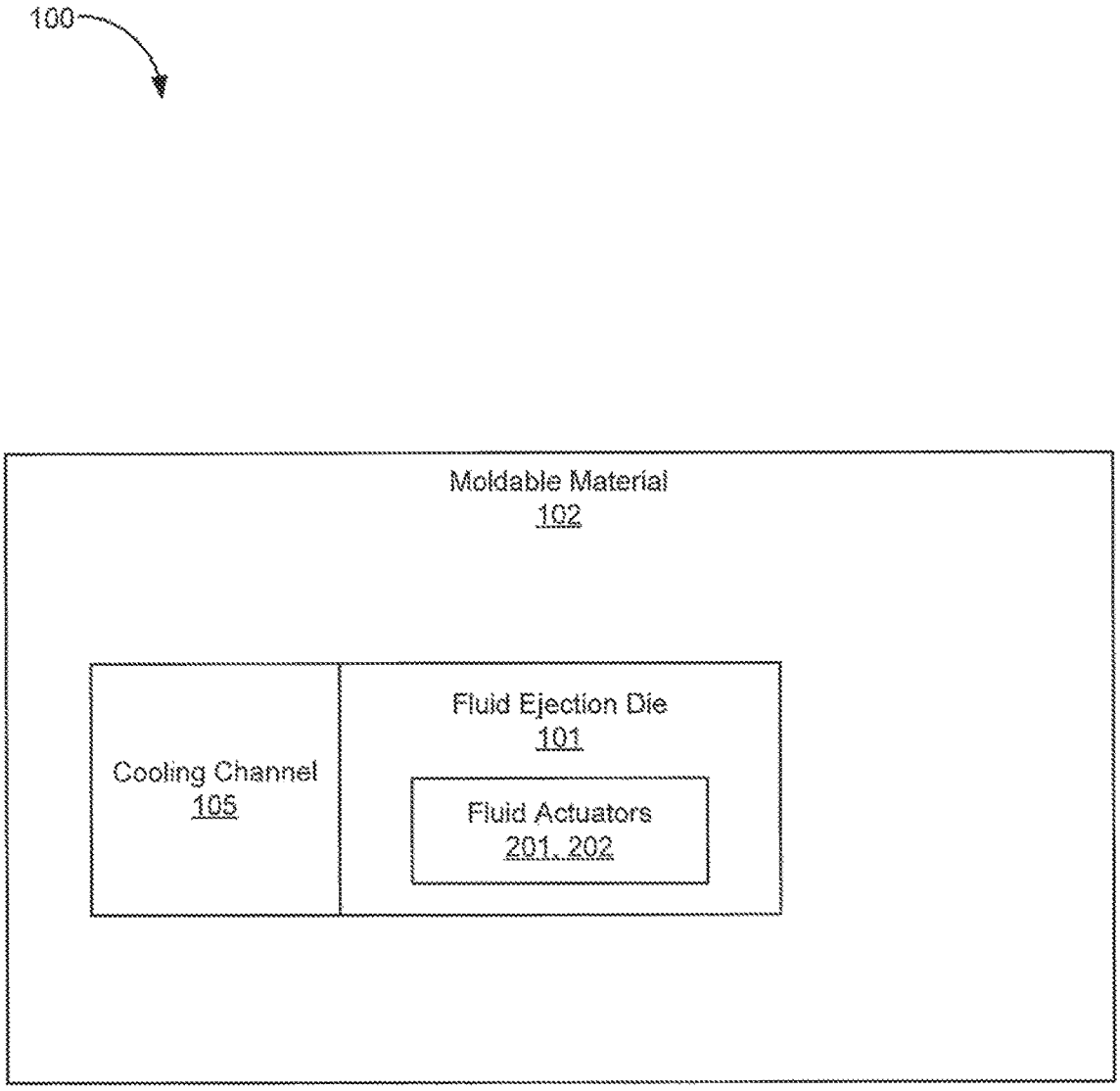
FIG. 1A is a block diagram of a fluid flow structure according to one example of the principles described herein.

Throughout the drawings, identical reference numbers designate but not necessarily identical, elements. The figures are not necessarily to scale, and the size of some parts may be exaggerated to more clearly illustrate the example shown. Moreover, the drawings provide examples and/or implementations consistent with the description; however the description is not limited to the examples and/or implementations provided in the drawings.

DETAILED DESCRIPTION

As mentioned above, the fluid ejection die may include resistive elements used to cause fluid to be ejected from the fluid ejection die. In some examples, the fluid may include particles suspended in the fluid that may tend to move out of suspension and collect in certain areas within the fluid ejection die as sediment. In one example, this sedimentation of particles may be corrected by including a number of fluid recirculation pumps to the fluid ejection die. In one example, the fluid recirculation pumps may be pump devices used to reduce or eliminate, for example, pigment settling within an ink by recirculating the ink through the firing chambers of the fluid ejection die and a number of by-pass fluidic paths.

However, addition of the fluid recirculation pumps along with the fluid ejection resistors may cause an undesirable amount of waste heat to accumulate within the fluid, the fluid ejection die, and other portions of the overall fluid ejection device. This increase in waste heat may cause thermal defects in the ejection of the fluid from the fluid ejection die.

Examples described herein provide a fluid ejection device. The fluid ejection device may include a fluid ejection die embedded in a moldable material, a number of fluid recirculation pumps within the fluid ejection die to recirculate fluid within a number of firing chambers of the fluid ejection die, and a number of cooling channels defined in the moldable material thermally coupled to the fluid ejection die. The fluid recirculated by the fluid recirculation pumps within the firing chambers of the fluid ejection die may be present within the cooling channels. In another example, the cooling channels convey a cooling fluid, the cooling fluid to transfer heat from the fluid ejection die.

In one example, an amount of moldable material may be included between the fluid ejection the and the cooling channels, in another example, at least a portion of the fluid ejection die may be exposed to the at least one of the cooling channels. The fluid ejection device may further include a number of heat exchangers the thermally coupled between the fluid ejection die and the cooling channels.

Examples described herein also provide a fluid cartridge. The fluid cartridge may include a fluid reservoir. The fluid cartridge may also include a fluid ejection device. The fluid ejection device may include a fluid ejection die embedded in a moldable material, a number of fluid recirculation pumps within the fluid ejection die to recirculate fluid within a number of firing chambers of the fluid ejection die, and a number of cooling channels defined in the moldable material thermally coupled to the fluid ejection die. The fluid cartridge may also include a controller to control ejection of the fluid from the fluid ejection die, and control the fluid recirculation pumps.

The fluid cartridge may further include a recirculation reservoir for recirculating a cooling fluid through the cooling channels. In this example, the controller controls the recirculation reservoir. In one example, the recirculation reservoir may include a heat exchange device to transfer heat from the cooling fluid. The cooling fluid may be same as the fluid recirculated Within the firing chambers of the fluid ejection die. In another example, the cooling fluid may be different than the fluid recirculated within the firing chambers of the fluid ejection die.

Examples described herein also provide a fluid flow structure. The fluid flow structure tray include a die sliver compression molded into a molding, a fluid feed hole extending through the die sliver from a first exterior surface to a second exterior surface, a fluid channel fluidically coupled to the first exterior surface, and a number of cooling channels defined in the moldable material thermally coupled to the die sliver. An amount of moldable material may be included between the die sliver and the roofing channels. In another example, at least a portion of the die sliver may to exposed to the at least one of the cooling channels. Further, in one example, the cooling channels convey a cooling fluid. In this example, the cooling fluid to transfer heat from the fluid ejection die.

As used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding a the present systems and methods. It will be apparent, however, to ore skilled in the art that the present apparatus, systems, and methods may be practiced without these specific details. Reference, in the specification to an example or similar language means that a particular feature, structure, or characteristic described in connection with that example is included as described, but may or may not be inducted in other examples.

Turning now to the figures, FIG. 1A is a block diagram of a fluid flow structure (100), according to one example of the principles described herein. The fluid flow structure (100) may include a fluid ejection die embedded in a moldable material (102). A number of fluid actuators (201, 202) may be included within the fluid ejection die (101). In one example, the fluid ejection die (101) may comprise a number of fluid actuators (201, 202). Examples a fluid actuators (201, 202) includes thermal-resistor-based fluid actuators, piezoelectric-membrane-based fluid actuators, other types of fluid actuators, or combinations thereof. In one examples, a fluid actuator (201, 202) may be disposed in an ejection chamber of a nozzle such that fluid may be ejected through a nozzle orifice of the nozzle responsive to actuation of the fluid actuator (201, 202). In such examples, a fluid actuator (201, 202) disposed in an ejection chamber may be referred to as a fluid ejector.

In some examples, a fluid actuator (201, 202) may be disposed in a fluidic channel. In these examples, actuation of the fluid actuator (201, 202) may cause displacement of fluid in the channel (i.e., a fluid flow). In examples in which a fluid actuator (201, 202) is disposed in a fluidic channel, the fluid actuators (201, 202) may be referred to as fluid pumps. In some examples, a fluid actuator pot 202) may be disposed in a fluid channel coupled to an ejection chamber and through which fluid may recirculate.

The fluid ejection device may also include a number of cooling channels, refined in the moldable material. The fluid channels may be thermally coupled to the fluid ejection die.

Figure 1B:
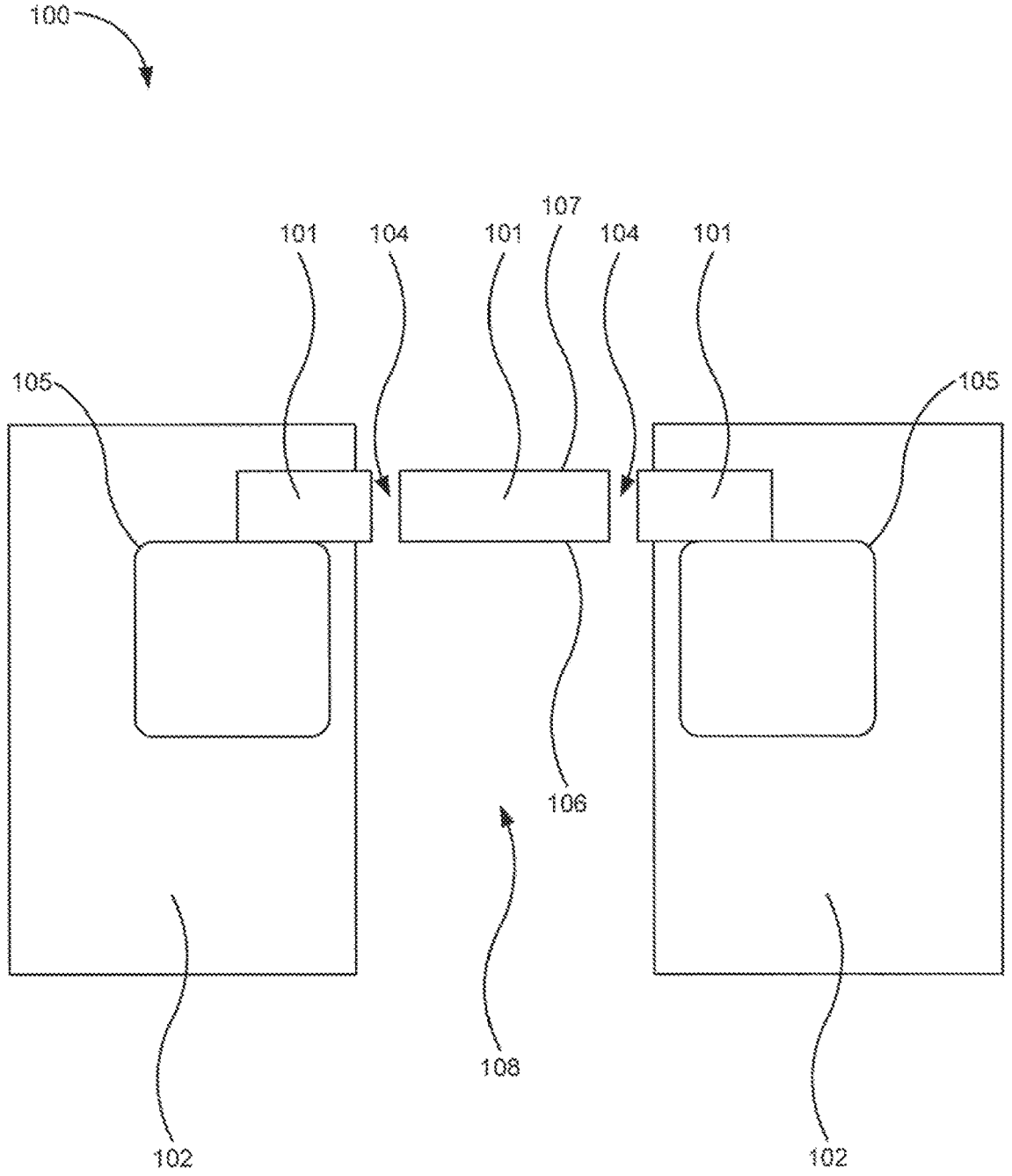
FIG. 1B is an elevation cross-sectional diagram of a fluid flow structure, according to another example of the principles described herein.

FIG. 1B is an elevation cross-sectional diagram of a fluid flow structure (100), according to another example of the principles described herein. A fluid flow structure (100) including those depicted throughout the figures may be any structure through which fluid flows. In one example, the fluid flow structures (100, 200, 300, 400, collectively referred to herein as 100) in, for example, FIGS. 1 through 4 may include a number of fluid ejection dies (101). The fluid ejection dies (101) may be used in, for example, printing fluids onto a substrate. Further, in one example, the fluid flow structures (100) may include fluid ejection dies (101) including, for example, a number of fluid firing chambers, a number of resistors for heating and firing the fluid from the firing ambers, a number of fluid feed holes, a number of fluid passageways, and other elements that assist in the ejection of fluid from the fluid flow structures (100, 200, 300, 400). In still another example, the fluid flow structures (100, 200, 300, 400) may include fluid ejection dies (101) that are thermal fluid-jet dies, piezoelectric fluid et dies, other types of fluid-jet dies, or combinations thereof.

In one example, the fluid flow structure (100, 200, 300, 400) includes a number of sliver die (101) compression molded into a moldable, material (102). A sliver die (101) includes a thin silicon, glass, or other substrate having a thickness on the order of approximately 650 micrometers (μm) or less, and a ratio of length to width (LAN) of at least three. In one example, the fluid flow structure (100) may include at least one fluid ejection die (101) compression molded into a monolithic body of plastic, epoxy mold compound (EMC), or other moldable material (102). For example, a print bar including the fluid flow structure (100, 200, 300, 400) may include multiple fluid ejection dies (101) molded into an elongated, singular molded body. The molding of the fluid ejection dies (101) within the moldable material (102) enables the use of smaller dies by offloading the fluid delivery channels such as fluid feed holes and fluid delivery slots from the fluid ejection die (101) to the molded body (102) of the fluid flow structure (100, 200, 300, 400). In this manner, the molded body (102) effectively grows the size of each fluid ejection die (101), which, in turn, improves fan-out of the fluid ejection die (101) for making external fluid connections and for attaching the fluid ejection dies (101) to other structures.

The fluid ejection device (100) of FIG. 1 may include at least one fluid ejection die (101) such as, for example, a sliver die embedded in the moldable material (102). A number of fluid feed holes (104) may be defined within and extending through the fluid ejection die (101) from a first exterior surface (106) to a second exterior surface (107) in order to allow the fluid to be brought from the back side of the fluid ejection die (101) to be ejected from the front side. Thus, a fluid channel (108) is defined in the fluid ejection die (101) and fluidically coupled between the first exterior or surface (106) and the second exterior surface (107).

A number of cooling channels (105) may be defined within the moldable material (102). The cooling channels (105) may be thermally coupled to the fluid ejection die (101) in order to draw heat from the fluid ejection die (101). The moldable material (102) such as an EMC may have a thermal conductivity (i.e., rate at which heat passes through a material) of approximately 2 to 3 watts per square meter or surface area for a temperature gradient of one kelvin for every meter thickness (W/mK). Further, in an example where the moldable material (102) has a filler material such as aluminum oxide ($AlO_3$), its thermal conductivity may be approximately 5 W/mk. In contrast, copper (Cu) and gold (Au) have a thermal conductivity of approximately 410 W/mK and 310 W/mK, respectively. Further, silicon (Si) of which the fluid ejection dies (101) may be made of have a thermal conductivity of approximately 148 W/mk. In one example, in order to make the transfer of waste from the fluid ejection die (101) more effective, at least one surface of the fluid ejection die may be exposed to the cooling channels (105).

In one example, the cooling channel (203) may transport a cooling fluid therein to assist in drawing the heat away from the fluid ejection the (101). In one example, the cooling fluid may be air passing through the cooling channels (105). In another example, the fluid introduced to the fluid ejection die (101) via the fluid channel (108) and elected by the fluid firing chambers (204) and associated firing resistors (201) of the fluid ejection die (101) is present within the cooling channels (105) and is used as a heat transfer medium.

In still another example, a cooling fluid other than air or the ejected fluid may be used as the heat transfer medium within the cooling channels (105). In this example, a coolant may be provided which flows through the cooling channels (105) and around the heat exchangers (105) to prevent the fluid ejection die (101) from overheating. The coolant transfers the heat produced by the resistors within the fluid ejection die (101) to other portions of the fluid flow structure (200) or exterior to the fluid flow structure in order to dissipate the heat. In this example, the coolant may keep its phase and remain as a liquid or gas, or may undergo a phase transition, with the latent heat adding to the cooling efficiency. When a phase transition within the coolant takes place, the coolant may be used to achieve below-ambient temperatures as a refrigerant.

Figure 2:
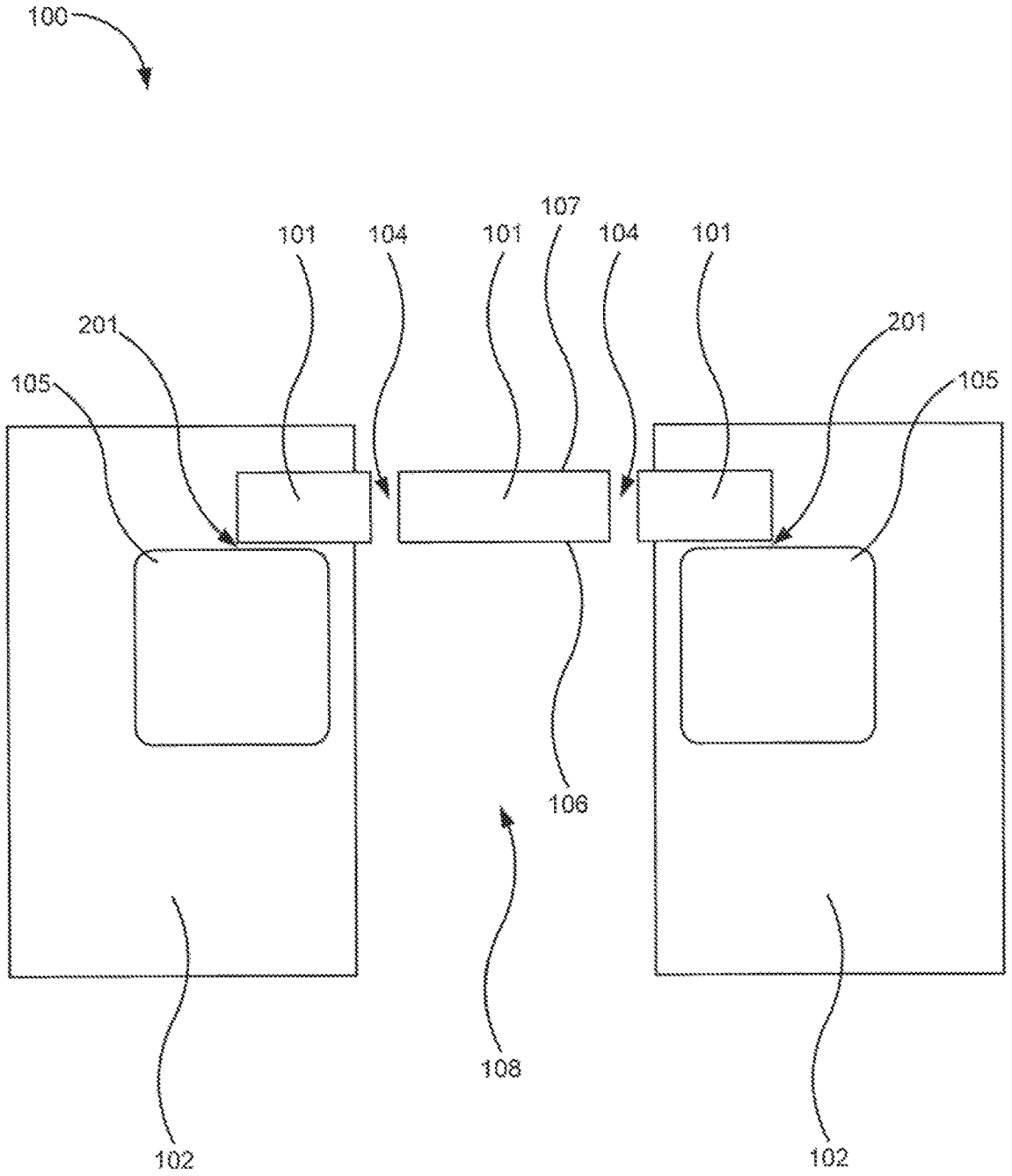
FIG. 2 is an elevation cross-sectional diagram of a fluid flow structure, according to another example of the principles described herein.

FIG. 2 is an elevation cross-sectional diagram of a fluid flow structure (200), according to another example of the principles described herein. Those elements similarly numbered in FIG. 2 relative to FIG. 1 are described above in connection with FIG. 1 and other portions herein. FIG. 2 includes cooling channels (105) that are thermally coupled to the fluid ejection die (101), but are not physically coupled to the fluid ejection die (101). In this example, an interposing portion (201) of moldable material (102) may be included. The interposing portion (201) of the moldable material (102) may be thin enough to allow for waste heat within the fluid ejection die (101) to be effectively dissipated to the cooling channels (105), but thick enough to ensure that any fluid traveling within the cooling channels (201) does not come into direct contact with the fluid ejection die (101). In this manner, the fluid ejection die (101) is not adversely effected by, for example, a coolant that is present within the cooling channels (105).

Figure 3:
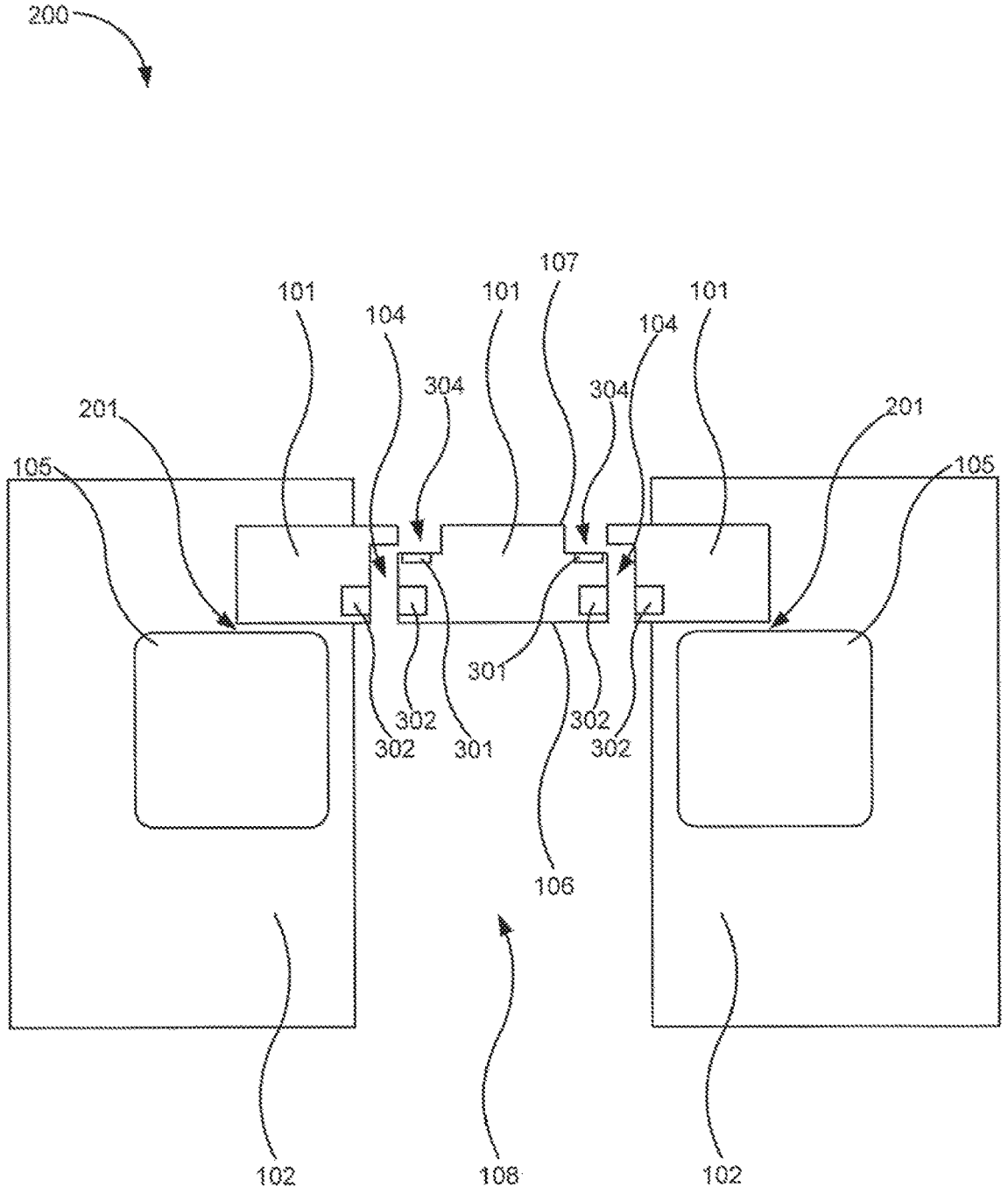
FIG. 3 is an elevation cross-sectional diagram of a fluid flow structure, according to still another example of the principles described herein.

FIG. 3 is an elevation cross-sectional diagram of a fluid flow structure (300), according to still another example of the principles described herein. Those elements similarly numbered in FIG. 3 relative to FIGS. 1 and 2 are described above in connection with FIGS. 1 and 2 and other portions herein. A number of fluid firing chambers (304) and associated firing resistors (301) are depicted within the fluid ejection die (101) of FIG. 3. The example fluid flow structure (300) of FIG. 3 further includes a number of fluid recirculation pumps (302) as described herein. The fluid recirculation pumps (302) may be located within a fluid passageway within the fluid ejection die (101).

Figure 4:
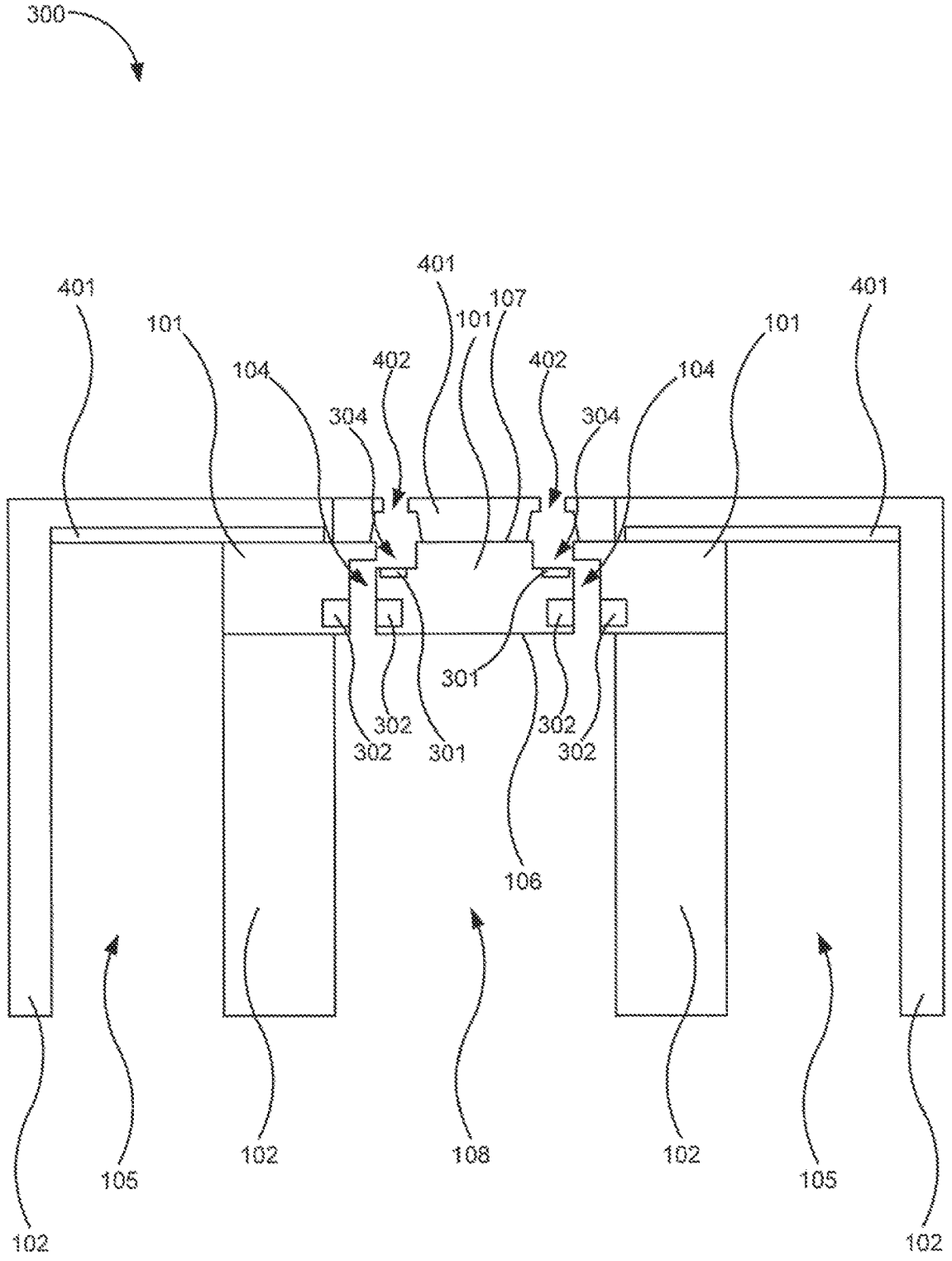
FIG. 4 is an elevation cross-sectional diagram of a fluid flow structure, according to yet another example of the principles described herein.

As described above, the fluid ejected by the fluid ejection die (101) may include particles suspended in the fluid that may tend to move out of suspension and collect in certain, areas within the find ejection the (101) as sediment. In one example, this sedimentation of particles may be corrected by it a number of fluid recirculation pumps (302) to the fluid election die (101). In one example, the fluid recirculation pumps may be micro-resistors that create bubbles within the fluid ejection die (101) that force the electable fluid through the firing chambers and by-pass fluidic paths of the fluid ejection die (101). In another example, the fluid recirculation pumps (302) may be piezoelectrically activated membranes that change the shape of a piezoelectric material when an electric field is applied, and force the electable fluid through the firing chambers and by-pass fluidic paths of the fluid ejection die (101). Actuation of the fluid recirculation pumps (302) and the firing chamber resistors (301) increases the amount of waste heat generated within the fluid ejection die (101). Thus, addition of the fluid recirculation pumps (302) along with the fluid ejection resistors (301) may cause an undesirable amount of waste heat to accumulate within the fluid, the fluid ejection die (101), and other portions of the overall fluid ejection device (100, 200, 300, 400). This increase in waste heat may cause thermal defects in the election of the fluid from the fluid ejection die (101). Thus, the cooling channels (105) may be used to transfer the waste heat from the fluid ejection die (101) as described herein. The example of FIG. 3 may include the FIG. 4 is an elevation cross-sectional diagram of a fluid flow structure (400), according to yet another example of the principles described herein. Those elements similarly numbered in FIG. 4 relative to FIGS. 1 through 3 are described above in connection with FIGS. 1 through 3 and other portions herein. The example of FIG. 4 includes a nozzle plate (401) through which the fluid ejection die (101) ejects the fluid. The nozzle plate (401) may include a number of nozzles (402) defined in the nozzle plate (401). Any number of nozzles (402) may be included within the nozzle plate (401), and, in one example, each firing chamber (304) includes a corresponding nozzle (402) defined in the nozzle plate (401).

The example of FIG. 4 further includes a number of heat exchangers (401). The heat exchangers (401) may be any passive heat exchange device that transfers heat generated by the fluid ejection die (101) to a fluid medium such as air or a liquid coolant within the cooling channels (105). The heat exchangers (401) may be a wire such as a copper wire, a bond ribbon, a heat pipe, a lead frame, other types of heat exchangers, or combinations thereof. The heat exchangers (401) may be thermally coupled to the first exterior surface (106) of the fluid ejection die (101), the second exterior surface (107) of the fluid ejection die (101), other surfaces of the fluid ejection die, or combinations thereof. In this manner, the heat exchangers (401) are able to draw heat generated by, for example, a number of the resistors (301) used for heating and firing the fluid from the firing chambers and included within the fluid ejection die (101), the number of the fluid recirculation pumps (302) within the fluid ejection die (101), and combinations thereof.

The cooling channels (105) may be thermally coupled to the heat exchangers (401) in order to draw heat from the fluid ejection die (101) via the heat exchangers (401). In order to make the heat exchangers (401) embedded in the moldable material (102) more effective in dissipating heat, at least a portion of the heat exchangers (401) may be exposed to the cooling channels (105).

Figure 5:
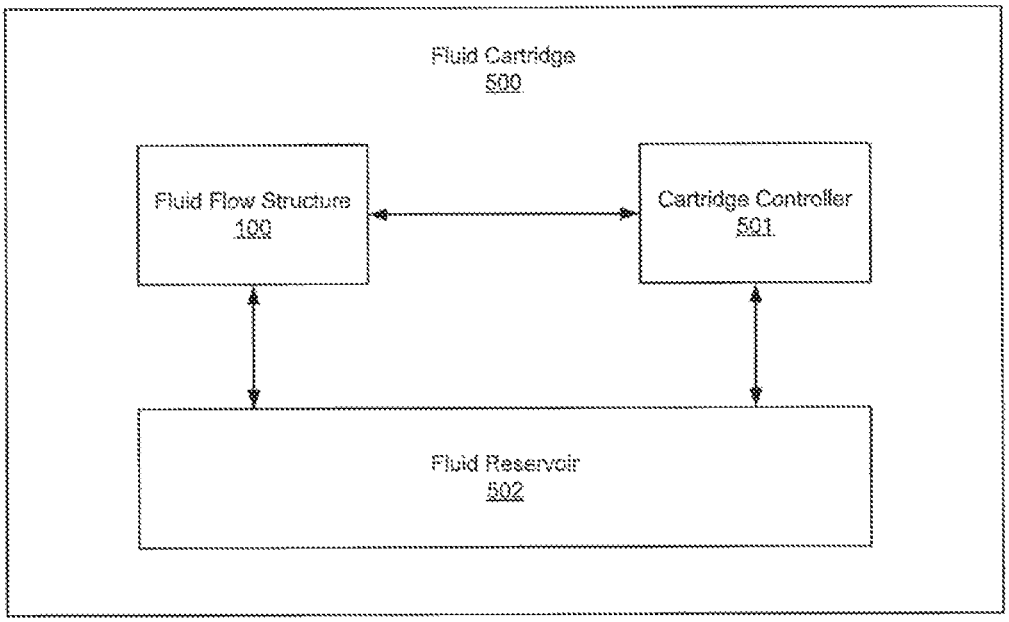
FIG. 5 is a block diagram of a fluid cartridge including a fluid flow structure according to one example of the principles described herein.

FIG. 5 is a block diagram of a fluid cartridge (500) including a fluid flow structure (100, 200, 300, 400, collectively referred to herein as 100), according to one example at the principles described herein. The fluid flow structure (100) depicted in FIG. 5 may be any of those fluid flow structures described in FIGS. 1 through 4 and throughout the remainder of this disclosure, or combinations thereof. The fluid cartridge (500) may include a fluid reservoir (502), a fluid flow structure (100), and a cartridge controller (501). The fluid reservoir (502) may include the fluid used by the fluid flow structure (100) as an ejection fluid during, for example, a printing, process. The fluid may be any fluid that may be ejected by the fluid flow structure (100) and its associated fluid ejection dies (101). In one example, the fluid may be an ink a water-based ultraviolet (UV) ink, pharmaceutical fluids, and 3D printing materials, among other fluids.

The cartridge controller (501) represents the programming, processor(s), and associated memories, along with other electronic circuitry and components that control the operative elements of the fluid cartridge (500) including, for example, the resistors (301, 302). The cartridge controller (501) may control the amount and timing of fluid provided to the fluid flow structure (100) by the fluid reservoir (502).

Figure 6:
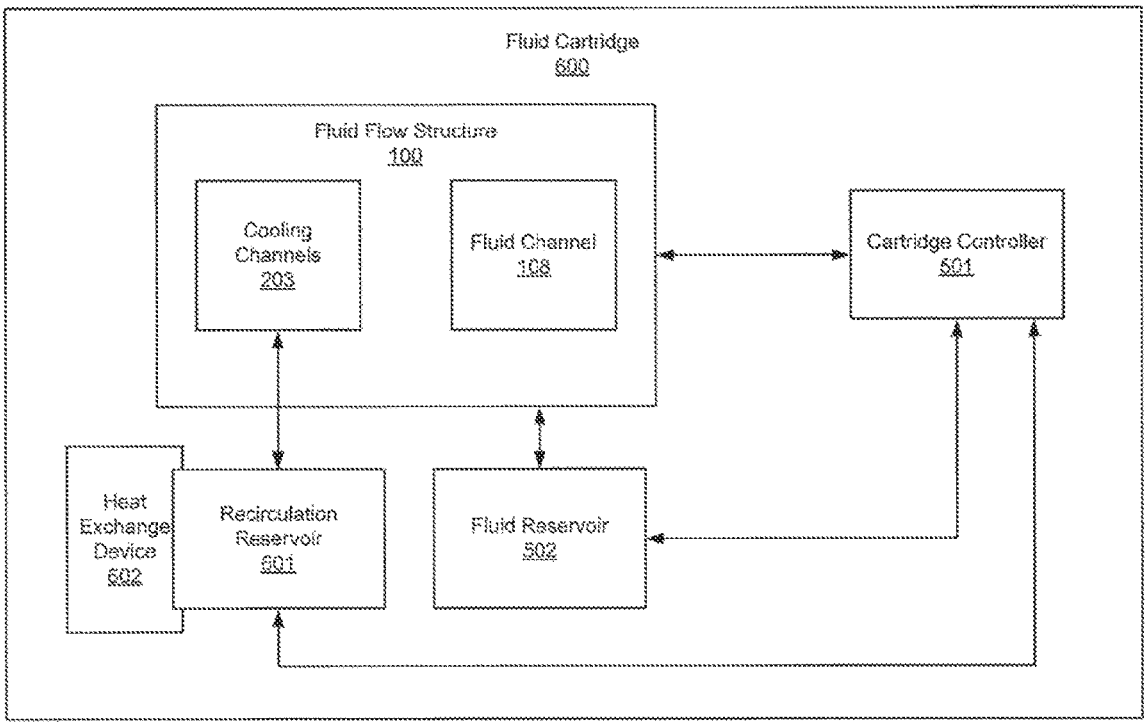
FIG. 6 is a block diagram of a fluid cartridge including a fluid flow structure, according to another example of the principles described herein.

FIG. 3 is a block diagram of a fluid cartridge (600) including a fluid flow structure (100), according to another example of the principles described herein. Those elements similarly numbered in FIG. 6 relative to FIG. 5 are described above in connection with FIG. 5 and other portions herein. The fluid cartridge (660) may further include a recirculation reservoir (601). The recirculation reservoir (601) recirculates a cooling fluid through the cooling channels (105)

within the fluid flow structure (100). In one example, the cartridge controller (501) may control the recirculation reservoir (601).

Further, in one example, the recirculation reservoir (601) may include a heat exchange device (602) to transfer heat from the cooling fluid within the recirculation reservoir (601). The heat exchange device (602) may be any passive heat exchanger that transfers the heat within the cooling fluid of the recirculation reservoir (601). In one example, the heat exchange device (602) dissipates the heat into ambient air surrounding the recirculation reservoir (601).

In one example, the cooling, fluid may be the same as the fluid recirculated within the firing chambers (304) of the fluid ejection die (101). In this example, the fluid reservoir (502) and the recirculation reservoir (601) may be fluidically such that the fluid within the fluid reservoir (502) is cooled as it is introduced into the recirculation reservoir (601). Further, in this example, the recirculation reservoir (601) may pump the fluid within the fluid reservoir (502) into the cooling channels (105).

In another example, the cooling fluid may be different than the fluid recirculated within the firing chambers (304) of the fluid ejection die (101). In this example, the fluid reservoir (502) and the recirculation reservoir (601) may be fluidically isolated from on another such that the fluid within the fluid reservoir (502) is introduced to the fluid ejection die (101) via the fluid channel (108), and the cooling fluid within the recirculation reservoir (601) is introduced into the cooling channels (105) via different channels. As described herein, the cooling fluid or coolant may be any fluid that transfers the heat produced by the resistors (301, 302) within the fluid ejection die (101) to other portions of the fluid flow structure (100) or exterior to the fluid flew structure in order to dissipate the heat. In this example, the coolant may keep its phase and remain as a liquid or gas or may undergo a phase transition, with the latent heat adding to the cooling efficiency. When a phase transition within the coolant farces place, the coolant may be used to achieve below-ambient temperatures a refrigerant.

Figure 7:
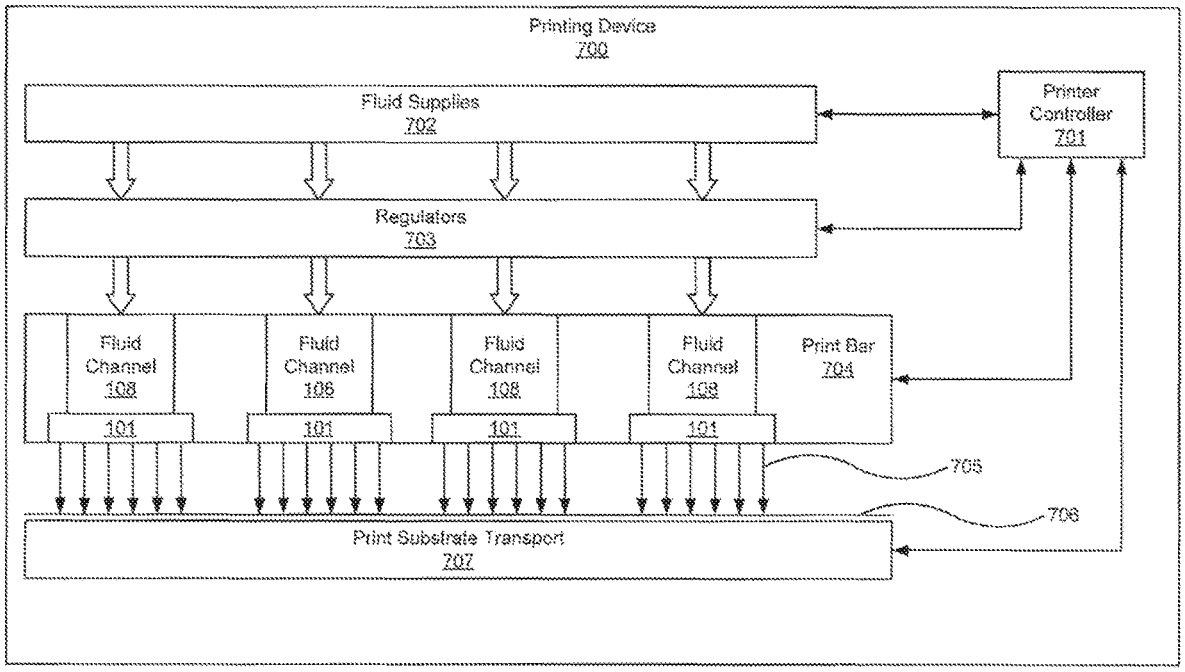
FIG. 7 is a block diagram of a printing device including a number of fluid flow structures in a substrate wide print bar, according to one example of the principles described herein.

FIG. 7 is a block diagram of a printing device (700) including a number of fluid flow structures (100) in a substrate wide print bar (704), according to one example of the principles described herein. The printing device (700) may include a print bar (704) spanning the width of a print substrate (706), a number of flow regulators (703) associated with the print bar (704), a substrate transport mechanism (707), printing fluid supplies (702) such as a fluid reservoir (502), and a controller (701). The controller (701) represents the programming, processor(s), and associated memories, along with other electronic circuitry and components that control the operative elements of the printing device (700). The print bar (704) may include an arrangement of fluid ejection dies (101) for dispensing fluid onto a sheet or continuous web of paper or other print substrate (706). Each fluid ejection die (101) receives fluid through a flow path that extend from the fluid supplies (702) into and through the flow regulators (703), and through a number of transfer molded fluid channels (108) defined in the print bar (704).

Figure 8:
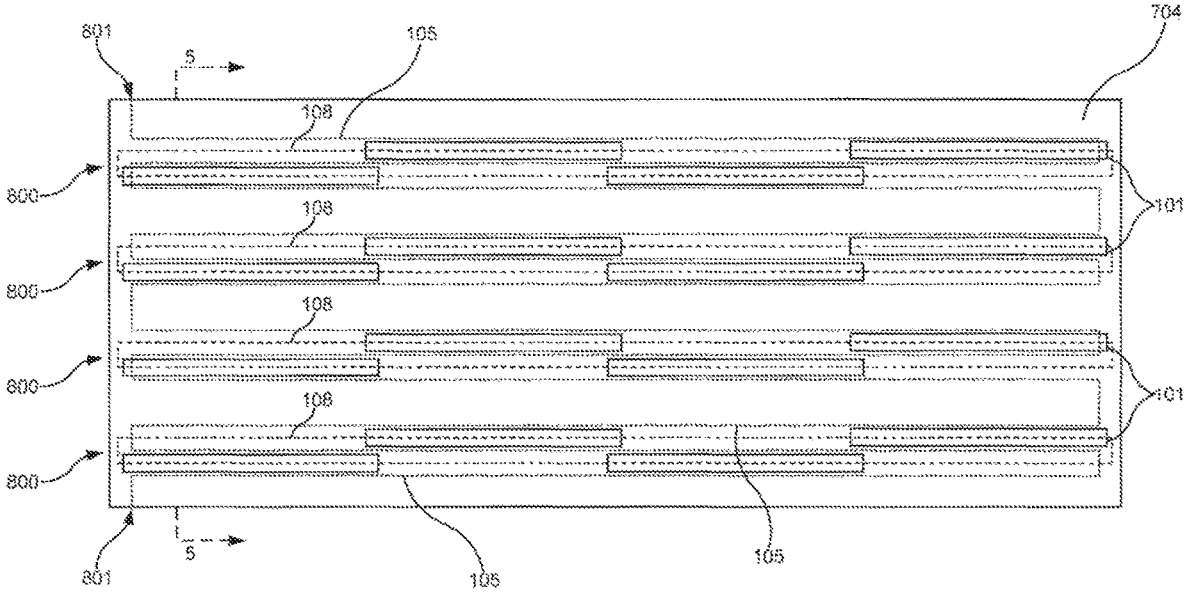
FIG. 8 is a block diagram of a print bar including a number of fluid flow structures, according to one example of the principles described herein.

FIG. 8 is a block diagram of a print bar (704) including a number of fluid flow structures (100), according to one example of the principles described herein. Further, FIG. 9 is a perspective view of a print bar (704) including a number of fluid flow structures (100), according to one example of the principles described herein. Thus, FIGS. 8 and 9 illustrate the print bar (704) implementing one example of the transfer molded fluid flow structures (100) as a printhead structure suitable for use in the printer (700) of FIG. 7. Referring to the plan view FIG. 8, the fluid ejection dies (101) are embedded in an elongated, monolithic, molding (102) and arranged end to end in a number of rows (800). The fluid ejection dies (101) are arranged in a staggered configuration in which the fluid ejection dies (101) in each row (800) overlap another fluid ejection die (101) in that same row (800). In this arrangement, each row (800) of fluid ejection dies (101) receives find from a different transfer molded fluid channel (108) as illustrated with dashed lines in FIG. 8. Although four fluid channels (108) feeding four rows (800) of staggered fluid ejection dies (101) is shown for us in, for example, printing four different colors such as cyan, magenta, yellow, and black, other suitable configurations are possible. FIG. 9 depicts a perspective se view of the print bar (704) taken along line 5-5 in FIG. 8.

The cooling channels (106) are depicted in FIG. 8. In the example, of FIG. 8, the cooling channels (105) include a continuous, serpentine-shaped channel with an inlet (801) and an outlet (802) for the fluid to enter and exit the print bar (704). However, any number of individual cooling channels (105) and inlets (801) and outlets (802) may be included within the print bar (704). Further, the cooling channels (105) may be arranged within the print bar (704) in any manner. Further, in one example, the inlets (801) and the outlets (802) of the cooling channels (105) may be coupled to the recirculation reservoir (601) as described herein.

Figure 9A:
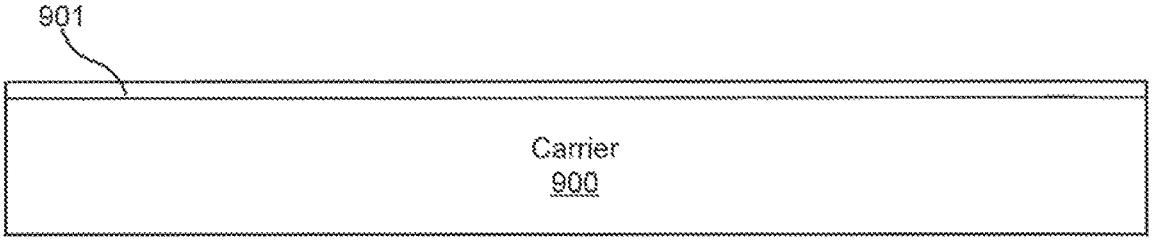
FIGS. 9A through 9E depict a method of manufacturing a fluid flow structure according to one example of the principles described herein.
Figure 9B:
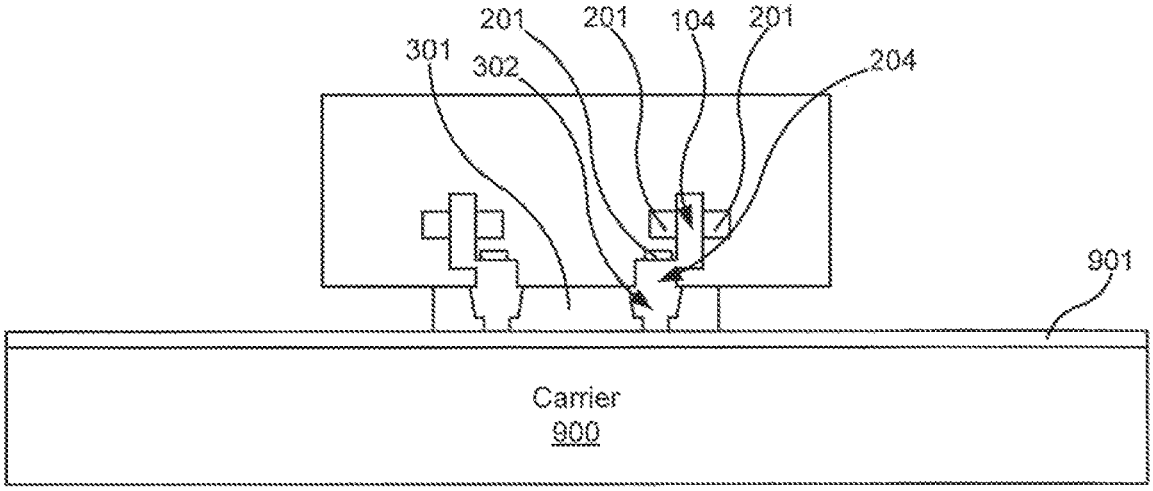
Figure 9C:
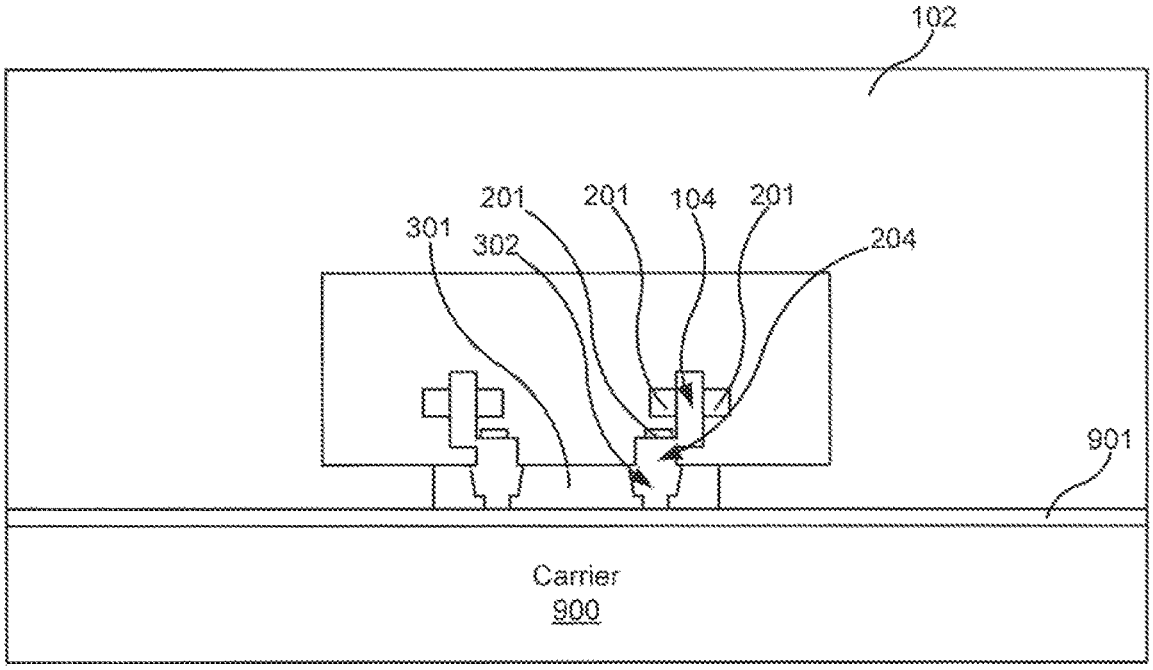

FIGS. 9A through 9E depict a method of manufacturing a fluid flow structure (100), according to one example of the principles described herein. Those elements similarly numbered in FIGS. 9A through 9E relative to FIGS. 1 through 8 are described above in connection with FIGS. 1 through 8 and other portions herein. The method may include adhering a thermal release tape (901) or other adhesive to a carrier (900) as depicted in FIG. 9A. In FIG. 9B, a preprocessed fluid ejection die (101) is coupled to the thermal release tape (901). In FIG. 9C, the entirety of the fluid flow structure (100) as depicted in FIG. 9B may be compression overmolded with the moldable material (102).

Figure 9D:
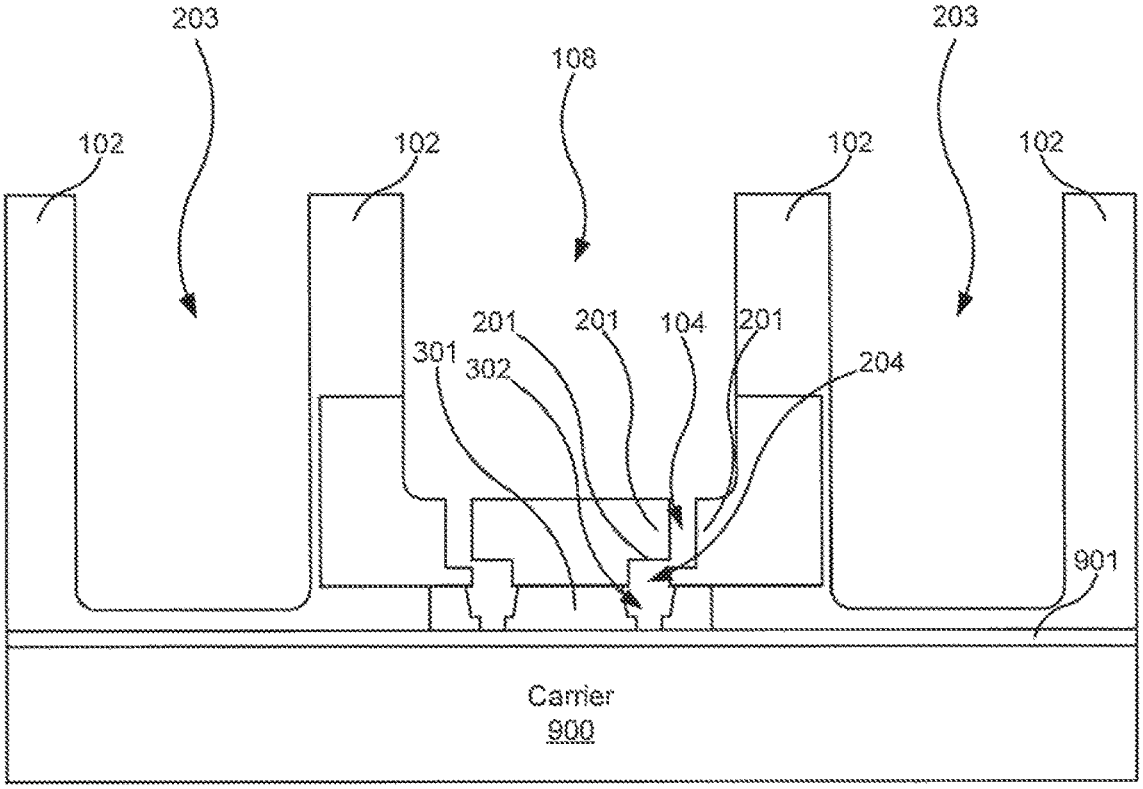
Figure 9E:
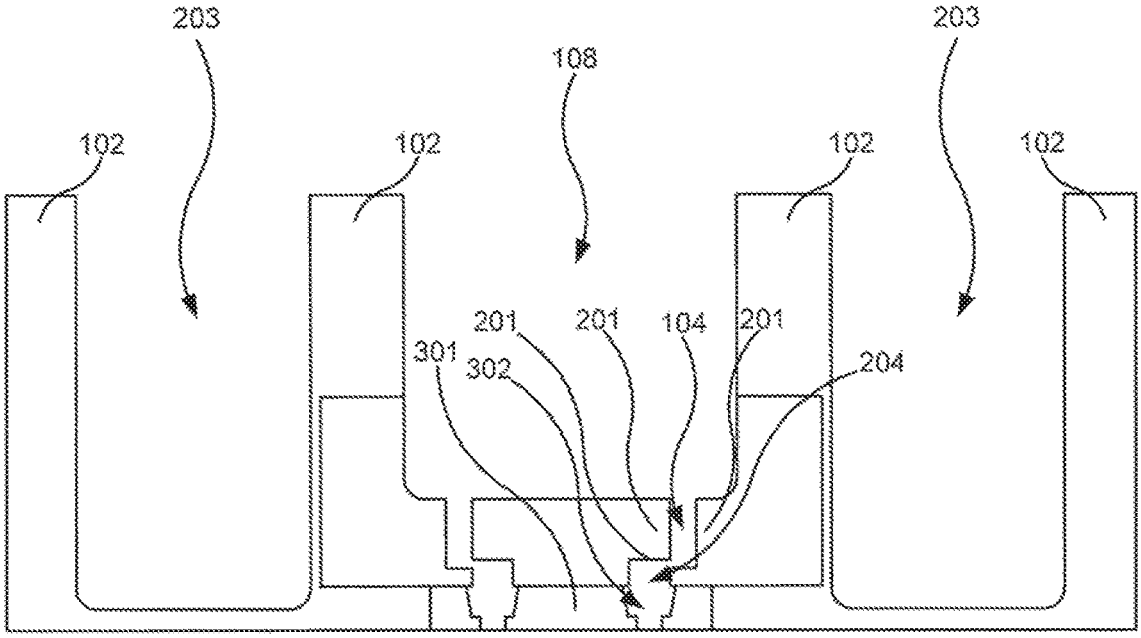

In FIG. 9D, the fluid channel (108) and a number of cooling channels (105) are formed in the moldable material (102). The fluid channel (108) and cooling channels (105) may be formed through a cutting process, laser ablation processes, or other material removal processes. At FIG. 9E, the thermal release tape (901) and carrier (900) are removed exposing the nozzle plate (301) and the coplanar surface of the moldable material (102).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and lock diagrams, may be implemented by computer usable program code. The computer usable program code may be provided to a processor of a general purpose computer, special purpose computer, or other programmable data processing apparatus to produce a machine, such that the computer usable program code, when executed via, for example, the printer controller (701) of the printing device (700), the cartridge controller (501) of the fluid cartridge (500, 600), or other programmable data processing apparatus, or combinations thereof implement the functions or acts specified in the flowchart and/or block diagram block or blocks. In one example, the computer usable program code may be embodied within a computer readable storage medium; the computer readable storage medium being part of the computer program product. In one example, the computer readable storage a non-transitory computer readable medium.

The specification and figures describe a fluid election device. The fluid ejection device may include a fluid ejection die embedded in a moldable material, a number of fluid actuators within the fluid ejection die to recirculate fluid within a number of firing chambers of the fluid ejection die, and a number of coding channels defined in the moldable material thermally coupled to the fluid ejection die. The fluid recirculated by the fluid recirculation pumps within the firing chambers of the fluid ejection die may be present within the cooling channels. In another example, the cooling channels convey a cooling fluid, time cooling, fluid to transfer heat from the fluid ejection die. This fluid ejection device reduces or eliminates pigment settling and decap when printing high solid electable fluids such as inks which may otherwise prevent proper printing at start up. Recirculation of the fluid within the fluid ejection die solves the pigment settling and decap issues, and the cooling channels and heat exchangers reduce or eliminate thermal defects during printing caused by waste heat generated by the fluid recirculation pumps.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid ejection device comprising:
a fluid ejection die embedded in a moldable material;
a number of fluid actuators within the fluid ejection die; and
a number of cooling channels defined in the moldable material thermally coupled to the fluid ejection die.

2. The fluid ejection device of claim 1, wherein the fluid actuators comprise a number of fluid recirculation pumps within the fluid ejection die to recirculate fluid within a number of firing chambers of the fluid ejection die, and wherein the fluid recirculated by the fluid recirculation pumps within the firing chambers of the fluid ejection die is present within the cooling channels.

3. The fluid ejection device of claim 1, wherein the cooling channels convey a cooling fluid, the cooling fluid to transfer heat from the fluid ejection die.

4. The fluid ejection device of claim 3, wherein the cooling fluid goes through a phase change to transfer heat from the fluid ejection die.

5. The fluid ejection device of claim 3, wherein the cooling fluid is air.

6. The fluid ejection device of claim 1, further comprising an amount of moldable material between the fluid ejection die and the cooling channels.

7. The fluid ejection device of claim 1, wherein at least a portion of the fluid ejection die is exposed to the at least one of the cooling channels.

8. The fluid ejection device of claim 1, further comprising a number of heat exchangers thermally coupled between the fluid ejection die and the cooling channels.

9. The fluid ejection device of claim 8, wherein the number of heat exchanges comprise metallic wires coupled between the fluid ejection die and number of cooling channels.

10. A print bar comprising:
a fluid ejection device comprising:
a plurality of fluid ejection dies embedded in a moldable material;
a number of fluid recirculation pumps within the fluid ejection dies to recirculate fluid within a number of firing chambers of the fluid ejection dies; and
a number of cooling channels defined in the moldable material thermally coupled to the fluid ejection dies.

11. The print bar of claim 10, further comprising:
a controller to:
control ejection of the fluid from the fluid ejection die; and
control the fluid recirculation pumps; and
a recirculation reservoir for recirculating a cooling fluid through the cooling channels, wherein the controller controls the recirculation reservoir.

12. The print bar of claim 11, wherein the recirculation reservoir comprises a heat exchange device to transfer heat from the cooling fluid.

13. The print bar of claim 11, wherein the cooling fluid is the same as the fluid recirculated within the firing chambers of the fluid ejection die.

14. The print bar of claim 11, wherein the cooling fluid is different than the fluid recirculated within the firing chambers of the fluid ejection die.

15. The print bar of claim 11, wherein the recirculation reservoir is fluidically coupled to a fluid reservoir which fluid reservoir is to hold the fluid recirculated by the number of fluid recirculation pumps.

16. The print bar of claim 11, wherein the recirculation reservoir is fluidically isolated from a fluid reservoir which fluid reservoir is to hold the fluid recirculated by the number of fluid recirculation pumps.

17. A fluid flow structure, comprising:
a die sliver compression molded into a moldable material;
a fluid feed hole extending through the die sliver from a first exterior surface to a second exterior surface;
a fluid channel fluidically coupled to the first exterior surface; and
a number of cooling channels defined in the moldable material thermally coupled to the die sliver.

18. The fluid flow structure of claim 17, further comprising an amount of moldable material between the die sliver and the cooling channels.

19. The fluid flow structure of claim 17, wherein at least a portion of the die sliver is exposed to the at least one of the cooling channels.

20. The fluid flow structure of claim 17, wherein the cooling channels convey a cooling fluid, the cooling fluid to transfer heat from the fluid ejection die.

* * * * *